US006917339B2

(12) United States Patent
Li et al.

(10) Patent No.: US 6,917,339 B2
(45) Date of Patent: Jul. 12, 2005

(54) MULTI-BAND BROADBAND PLANAR ANTENNAS

(75) Inventors: RongLin Li, Atlanta, GA (US); Emmanouil M. Tentzeris, Atlanta, GA (US); Joy Laskar, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 40 days.

(21) Appl. No.: 10/671,848

(22) Filed: Sep. 25, 2003

(65) Prior Publication Data

US 2004/0212545 A1 Oct. 28, 2004

Related U.S. Application Data

(60) Provisional application No. 60/413,327, filed on Sep. 25, 2002.

(51) Int. Cl.[7] ..... H01Q 1/24; H01Q 11/12

(52) U.S. Cl. ..... 343/702; 343/729; 343/742

(58) Field of Search ..... 343/700 MS, 702, 343/741, 742, 866, 867, 729; H01Q 1/24, 11/12

(56) References Cited

U.S. PATENT DOCUMENTS

| | | | | |
|---|---|---|---|---|
| 4,644,361 | A | * 2/1987 | Yokoyama | 343/700 MS |
| 5,365,246 | A | * 11/1994 | Rasinger et al. | 343/702 |
| 6,466,170 | B2 | 10/2002 | Zhou | |
| 6,504,511 | B2 | 1/2003 | Andersson | |
| 6,535,170 | B2 | * 3/2003 | Sawamura et al. | 343/702 |
| 6,573,867 | B1 | 6/2003 | Desclos | |
| 6,573,869 | B2 | 6/2003 | Moore | |
| 6,603,429 | B1 | 8/2003 | Bancroft | |
| 6,686,886 | B2 | * 2/2004 | Flint et al. | 343/702 |
| 6,801,168 | B1 | * 10/2004 | Yeh | 343/700 MS |

OTHER PUBLICATIONS

Tefiku, Faton; Grimes,Craig A.; Design of Broad–Band and Dual–Band Antennas Comprised of Series–Ged Printed–Strip Dipole Pairs; IEEE Transactions on Antennas and Propagation; vol. 48, No. 6; Jun. 2000.

Wang, Kin–Lu; Compact and Broadband Microstrip Antennas; Wiley Series In Microwave and Optical Engineering: John Wiley and Sons; Feb. 2002.

Bhartia, P.; Bahl, Inder; Garg, R.; Ittipboon, A. Microstrip Antenna Design Handbook; Artech House Antennas and Propagation Library; Artech House Publishing; Jan. 2001.

Doufexi, A.; Armour, S.; Karlsson, P.; Nix, A.; Bull, D.; A Comparison of HIPERLAN/2 and IEEE 802. 11a; IEEE Publications, 2000.

Lansford, J.; Nevo, J.; Monello, B.; Wi–Fi and Bluetooth: Enabling Coexistence; Compliance Engineering; 2001.

* cited by examiner

*Primary Examiner*—Hoanganh Le
(74) *Attorney, Agent, or Firm*—Nora M. Tocups

(57) ABSTRACT

Antennas of broadband and multi-band operation are presented. A broadband planar antenna includes two inverted-L antennas (ILAs) facing each other across a gap. One of the ILAs is input fed, and the other is electromagnetically coupled. The positioning of the gap affects the bandwidth. A dual-band planar antenna includes two ILAs facing each other across a gap with one of the ILAs being input fed, and the other being coupled. This dual-band planar antenna also includes a monopole antenna disposed between the two ILAs. A triple-band planar antenna includes two ILAs facing each other across a gap with one of the ILAs being input fed and the other IPA being coupled. This triple-band antenna also includes a monopole antenna disposed between the two ILAs, and a conductor extending horizontally from the monopole antenna towards, but not reaching the coupled ILA. Another dual-band antenna includes an inner cut loop antenna encompassed by an outer cut loop antenna. Each of the cut loop antennas includes two ILAs with one of the ILAs being input fed and the other being coupled.

20 Claims, 8 Drawing Sheets

MULTI-BAND BROADBAND PLANAR ANTENNAS

RELATED APPLICATION

This application claims priority to and the benefit of the prior filed co-pending and commonly owned provisional patent application, which has been assigned U.S. patent application Ser. No. 60/413,327, entitled "Multi-band broadband planar wire antennas for wireless communication handheld terminals," filed on Sep. 25, 2002, and incorporated herein by this reference.

FIELD OF THE INVENTIONS

The inventions relate generally to antennas, and more particularly to planar antennas with multi-band and broadband functionalities such as may be used with mobile communication devices and in other compact antenna applications.

BACKGROUND OF THE INVENTIONS

In recent years, there has been a tremendous increase in the use of wireless communication devices. The increased use has filled or nearly filled existing frequency bands. As a result, new wireless frequency band standards are emerging throughout the world. For example, the existing $1^{st}$ (1G) and $2^{nd}$ (2G) generation cellular mobile communication systems operate at:

- the AMPS (824–894 MHz) and PCS (1850–1990 MHz) bands in North America;
- the GSM (880–960 MHz) and DCS (1710–1880 MHz) bands in Europe; and
- the PDC (810–915 MHz) and PHS (1895–1918 MHz) bands in Japan.

For future wireless communication systems, such as the emerging 3rd generation (3G) systems or beyond, new spectrum may be allocated around 2 GHz (e.g., already identified 1920–2170 MHz band for UMTS or IMT2000).

Like cellular mobile communications systems, Wireless Local Area Networks (WLANs) also use various frequency bands. IEEE 802.11b, Bluetooth, and HomeRF operate in the 2.4 GHz ISM band (2.400–2.485 GHz). IEEE802.11a and HiperLAN (in Europe) will use the 5 GHz ISM band (5.15–5.35 GHz and 5.725–5.825 GHz for IEEE802.11a, 5.15–5.25 GHz for HiperLAN1 and 5.15–5.35 GHz for HiperLAN2). Japan has started the development of standards for WLAN devices in the 5 GHz band.

As the frequency standards throughout the world change and evolve, wireless devices that can operate at the old and the new frequency standards are needed.

Increased functionality is another factor that drives the need for wireless devices that can operate at multiple frequencies. New wireless devices may provide multiple functions, but one or more of the functionalities may only be available at a respective one or more different frequencies from the base operating frequency. Thus, there is a need for wireless devices that can operate and implement functionalities at more than one frequency.

Yet another factor that drives the need for wireless devices that can operate at multiple frequencies is the desire of users for multi-functional services that operate at high data speeds including voice, video, and data transmissions. A wireless device may provide such services with automatic access and seamless roaming if the device can operate across multiple frequency bands.

The antenna is a key component in the realization of such a multi-mode wireless device. It is desirable for an antenna used in a multi-mode wireless device to include broadband performance for use in successive bands. It is also desirable for such an antenna to have multi-band performance for separated bands including far-separated bands. In addition to broadband and multi-band performance, it is desirable for such an antenna to be of a small size, a simple structure, and be of lightweight materials so as to be easily mounted in a handheld terminal with relatively low cost. Further, the radiation patterns in all service bands of such an antenna should be omni-directional and polarization-mixed to adapt to land-mobile propagation environments.

In recent years, a great number of new antenna structures have been developed for dual-band or triple-band operations in wireless communication handsets. A simple way to realize dual-band operation is to directly feed two antenna elements, each of which has a separate resonant frequency. For example, a combination of a monopole and a helical antenna, where the monopole is placed through the middle of the helix in the axial position and is simply connected to the end of the helix, has been successfully applied in GSM/DCS bands. Directly feeding two monopoles with different lengths can also result in two resonant frequencies. Another dual-band operation includes electromagnetically coupling two separate radiating elements. A coupling dual-band dipole antenna has been developed for WLAN applications in the 2.4 and 5.2 GHz bands. By coupling a rectangular element at the high frequency and an L-shaped element at the lower frequency, a dual-band operation was achieved for a planar inverted-F antenna (PIFA). The triple-band operation of the PIFA was implemented by adding one more L-shaped radiator.

Usually, a dual-band or triple-band antenna has a narrow bandwidth at each band. In order to achieve a broadband multi-band operation, some specific techniques or additional structures have to be incorporated. For instance, a broadband dual-band operation could be realized by properly notching a rectangular patch. The bandwidth of the higher band for a dual-band PIFA was increased by adding one more resonator. By introducing a stacked element, by making the longer and shorter dipoles resonate, respectively, at slightly below and slightly above the center frequency, or by adding some parasitic structures, the bandwidth at one of the two bands of a dual-band antenna may be increased. Yet, broadband performance is desired at every band of a multi-band antenna.

Accordingly, there is a need for multi-band broadband antennas. In particular, there is a need for multi-band broadband antennas that are of small size, simple structure, and lightweight materials so as to be easily mounted in a handheld terminal with relatively low cost.

SUMMARY OF THE INVENTIONS

The inventions satisfy the need for multi-band broadband antennas such as may be used in wireless communication devices. Examples are presented of a broadband planar antenna, of two dual-band antennas, and or a triple-band antenna pursuant to the inventions. The antennas of the inventions have the advantages of being of simple structures such that they may be implemented in a small size, of lightweight materials, and at a relatively low cost.

The inventions include an antenna made up of two inverted-L antennas (ILAs) facing each other across a gap. This antenna may be referred to as a loop antenna with a gap. One of the ILAs is fed by an input, and may be directly fed by a coaxial cable input. The other ILA is electromagnetically coupled with respect to the fed ILA. The coupled ILA faces the fed ILA, but is separated from the fed ILA by a gap.

The length of the coupled ILA is longer than the fed ILA. In particular, the fed ILA, the coupled ILA, and the gap may be positioned with respect to each other to form three sides of a square, and may include a ground plane forming the fourth side of the square. Even more particularly, each of the ILAs may include a vertical leg of the same length that are parallel with respect to each other. Each of the ILAs also may include a horizontal leg, but the horizontal leg of the fed ILA may be shorter than the coupled ILA. In other words, the horizontal leg of the coupled ILA may be longer than the horizontal leg of the fed ILA.

The inventions also include a dual-band antenna. An exemplary dual-band antenna may include an inverted-L antenna (ILA) referred to as the "first" ILA and another ILA referred to as the "second" ILA. In this example, the second ILA is electromagnetically coupled with respect to the first ILA, faces the first ILA, and is separated from the first ILA by a gap. The second ILA may be longer than the first ILA. In addition to the two ILAs, the exemplary dual-band antenna includes a monopole antenna disposed between the first ILA and the second ILA, and operative to receive input. Further, a connection exists between the monopole antenna and the first ILA to feed input to the first ILA. The connection may connect to the monopole antenna near its base and to the first ILA at its base. Each of the ILAs has a horizontal leg with the horizontal leg of the first ILA being shorter than the horizontal leg of the second ILA. The monopole antenna may be shorter than the vertical leg of the second ILA.

In addition, the inventions include a triple-band antenna. An exemplary triple-band antenna may include an inverted-L antenna (ILA) referred to as the "first" ILA and another ILA referred to as the "second" ILA. In this example, the second ILA is electromagnetically coupled with respect to the first ILA, faces the first ILA, and is separated from the first ILA by a gap. The second ILA may be longer than the first ILA. In addition to the two ILAs, the exemplary triple-band antenna includes a monopole antenna disposed between the first ILA and the second ILA, and operative to receive input through a feed probe. Further, a connection exists between the monopole antenna and the first ILA to feed input to the first ILA. The connection may connect to the monopole antenna near its base and to the first ILA at its base. A conductor is connected to the monopole antenna opposite to the connection. The conductor extends horizontally from the monopole antenna towards, but not reaching, the second ILA. The conductor and the feed probe combine to form a third ILA in this antenna.

Further, the inventions include another dual-band antenna. An exemplary dual-band antenna may include an inner cut loop antenna encompassed by an outer cut loop antenna. The inner cut loop antenna may include a "first" inverted-L antenna (ILA) facing a "second" ILA across a "first" gap. The first ILA is fed input while the second ILA is electromagnetically coupled at least to the first ILA. The outer cut loop antenna includes a "third" ILA facing a "fourth" ILA across a "second" gap. The third ILA is fed input via a feed probe and a connection connected to the first ILA of the inner cut loop antenna while the fourth ILA is electromagnetically coupled at least to the third ILA. a

DETAILED DESCRIPTION

The inventions include multi-band broadband planar antennas such as may be used with mobile communication devices and in other compact antenna applications. Advantageously, the inventions provide multi-band broadband antennas that may be of small size, simple structure, and lightweight materials so as to be easily mounted in a handheld terminal with relatively low cost.

Figure 1:
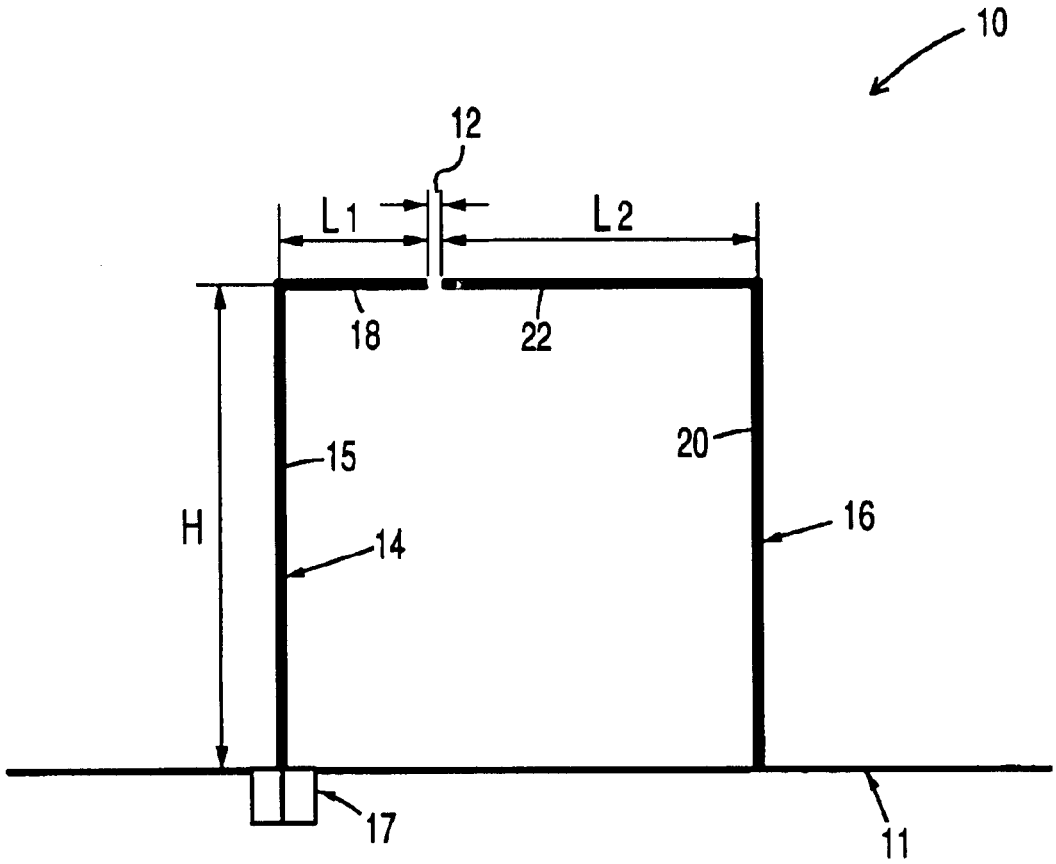
FIG. 1 illustrates an exemplary loop antenna with a gap for bandwidth enhancement according to the inventions.
Figure 2:
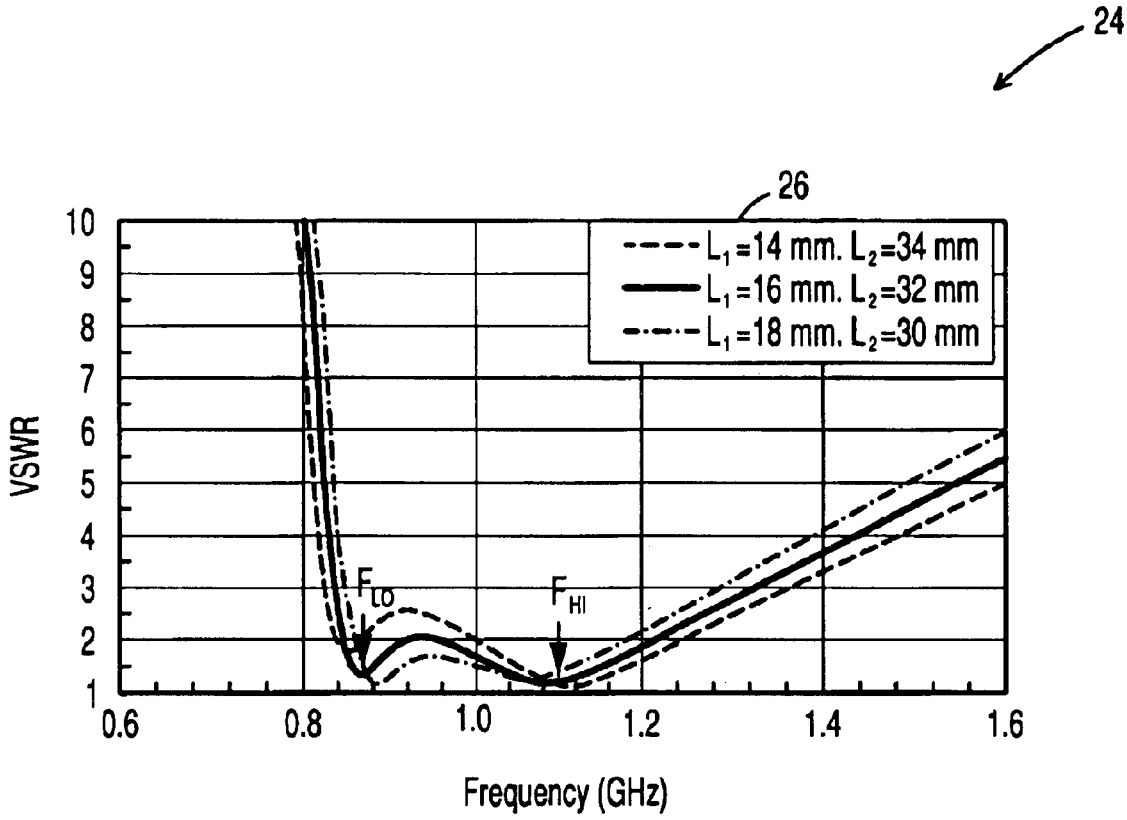
FIG. 2 is a graph of the Voltage Standing Wave Ratio (VSWR) for the exemplary antenna of FIG. 1.

FIGS. 1–2—Loop Antenna with a Gap

FIG. 1 illustrates an exemplary broadband planar antenna 10 according to the inventions. In particular, the exemplary broadband planar antenna 10 may be considered a square wire loop antenna on a ground plane 11 with a gap 12, and may be referred to as a loop antenna with a gap. As explained below, the position of the gap 12 in the loop affects the bandwidth of the antenna 10.

The antenna 10 illustrated in FIG. 1 may also be considered to be comprised of two Inverted-L Antennas (ILAs) 14, 16. In the exemplary embodiment, ILA 14 has a vertical leg 15 of height H connected at its top at a right angle to the right to a horizontal leg 18 of length L1. ILA 14 is directly fed by an input 17 such as a coaxial cable input.

The other ILA, ILA 16, may be said to face the directly fed ILA 14. ILA 16 has a vertical leg 22 of height H parallel to the vertical leg 15 of ILA 14. ILA 16, like ILA 14, has a horizontal leg 22 connected to the top of its vertical leg 20 at a right angle. But the horizontal leg 22 of ILA 16 is connected at a right angle to the left of its vertical leg 20, and the horizontal leg 22 of ILA 16 is of length L2. In effect, the horizontal leg 18 of ILA 14 faces the horizontal leg 22 of ILA 16 across the gap 12 of the antenna 10. ILA 16 further differs from ILA 14 in that ILA 16 is excited by electromagnetic coupling with respect to the directly fed ILA 14.

Advantageously, the broadband design of antenna 10 is achieved by making the length of the coupled ILA 16 longer than the directly fed ILA 14. Given that the heights of the vertical legs 15, 20 of the respective ILAs 14, 16 are the same (as noted, the antenna 10 may be considered a square loop antenna with a gap), the longer length of the coupled ILA 16 is achieved by making its horizontal leg 22 longer than the horizontal leg 18 of the directly fed ILA 14. In other words, L2 is greater than L1 as illustrated in FIG. 1.

The relative lengths of the horizontal legs 18, 22 define the position of the gap 12 in the antenna 10. Thus, a change in the relative lengths causes an adjustment in the position of the gap 12 in the antenna 10. The shorter the horizontal leg 18 of the directly fed ILA 14, the closer the gap 12 in the antenna 10 is to the vertical leg 15 of ILA 14. Conversely, the longer the horizontal leg 18 of the directly fed ILA 14, the closer the gap 12 is to the vertical leg 20 of the coupled ILA 16. The position of the gap 12 affects the bandwidth of the antenna 10.

FIG. 2 is a graph 24 of frequency (GHz) vs. simulated Voltage Standing Wave Ratio (VSWR) for the exemplary antenna 10 of FIG. 1 with different gap positions. The simulation was carried out using the MoM (Method of Moment) based Numerical Electromagnetics Code (NEC V1.1) and under the assumption of an infinite ground plane 11. Graph 24 includes a table 26 with three entries relating to the respective lengths of the horizontal legs 18, 22 of the ILAs 14, 16 used in the simulation. Each entry includes a measured length of the horizontal leg 18 of the directly fed ILA 14 and a measured length of the horizontal leg 22 of the coupled ILA 16. Each entry relates to the simulation and is plotted on the graph 24. Note, in this example, the gap 12=2 mm.

FIG. 2 illustrates that as the difference between the length L2 of the horizontal leg 22 of the coupled ILA 16 and the length L1 of the horizontal leg 18 of the directly fed ILA 14 (e.g., L2−L1) decreases, the respective resonant frequencies for the ILAs 14, 16 (FHI for ILA 14 and FLO for ILA 16) move closer to each other. The maximum bandwidth for a certain criterion of VSWR is obtained when all the VSWR within this frequency band is below the VSWR threshold. For this example, the bandwidth for a VSWR criterion=2 is calculated to be 35%. Therefore, the optimum VSWR of 2 or less is achieved for a very wide bandwidth.

Figure 3:
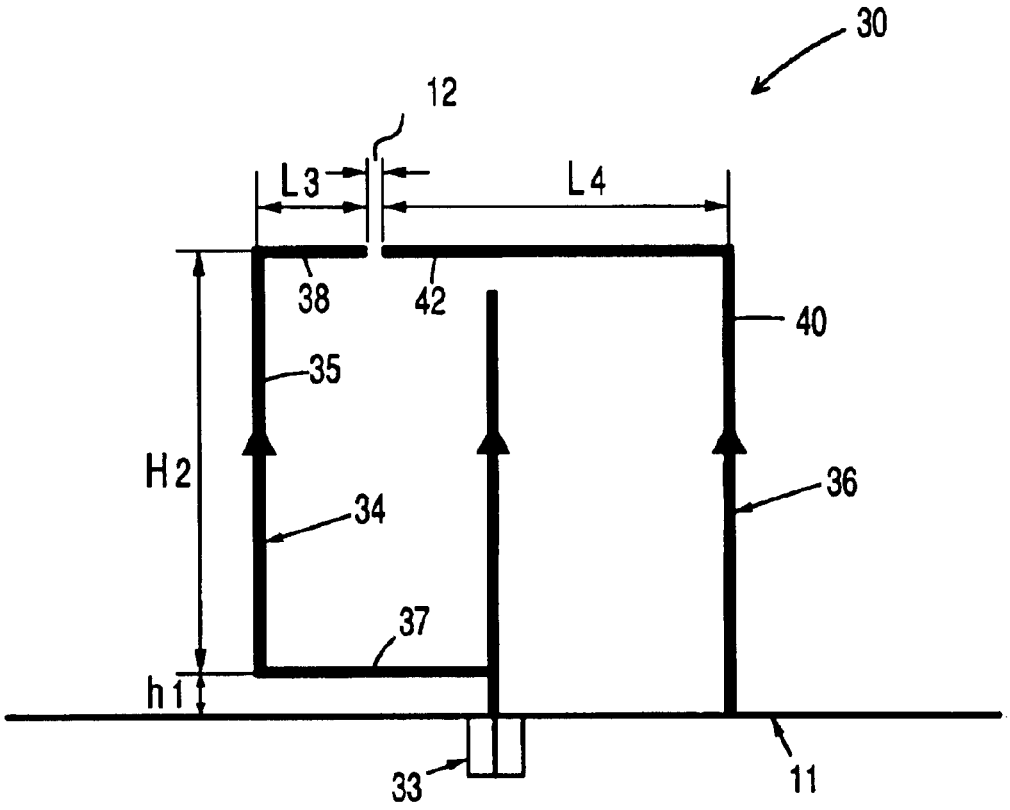
FIG. 3 illustrates an exemplary planar dual-band loop-monopole antenna according to the inventions.
Figure 4:
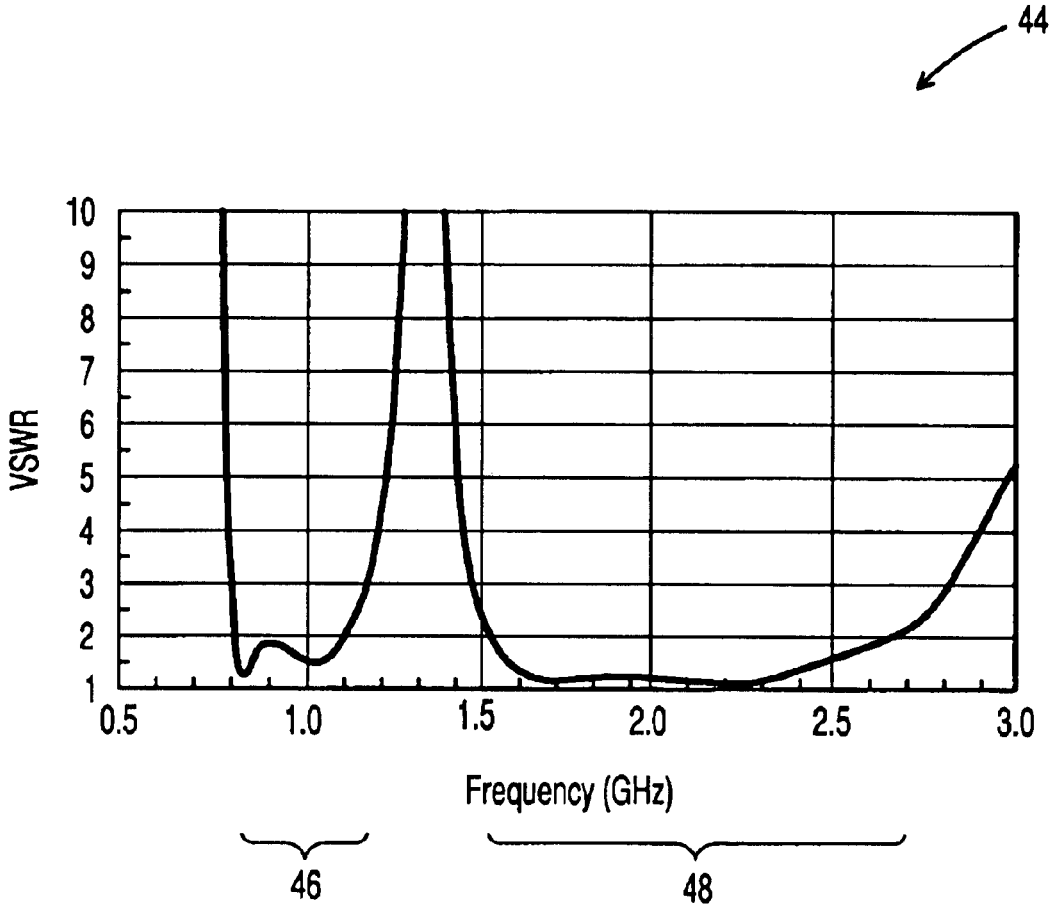
FIG. 4 is a graph of the VSWR for the exemplary antenna of FIG. 3.

FIGS. 3–4—Dual-Band Antenna

FIG. 3 illustrates an exemplary dual-band broadband planar antenna 30 according to the inventions. The antenna 30 of FIG. 3 is similar to the antenna 10 of FIG. 1 in that each may be considered a square wire loop antenna on a ground plane 11 with a gap 12. The antenna 30 of FIG. 3 differs and provides dual-band operation by the addition of a monopole antenna 32 in the middle of the antenna 30 plus some adjustments. A monopole antenna may also be referred to as a monopole herein.

More particularly, like the antenna 10 of FIG. 1, the antenna 30 of FIG. 3 may be considered to be comprised of two Inverted-L antennas (ILAs) 34, 36 that face each other across a gap 12. One of the ILAs 34 is fed input (as explained below), and the other ILA 36 is electromagnetically coupled to the fed ILA 34 and/or coupled with respect to the other parts of the antenna 30. Each of the ILAs 34, 36 includes a vertical leg, respectively 35, 40.

The antenna 30, however, differs from the antenna 10 because the antenna 30 has a vertical monopole 32 rising from the ground plane 11 and centered between vertical legs 25, 30 of the ILAs 34, 36 of the antenna 30. The monopole 32 has a length less than the length (or height) of the vertical legs 25, 30 of the ILAs 34, 36. The monopole 32 is fed from an input 33, such as by a coaxial cable input, which also feeds ILA 34 through a connection 37 from the monopole 32 to the vertical leg 35 of the ILA 34. For example, as illustrated in FIG. 3, the input 33 may be centered between the vertical legs 35, 40 of the ILAs 34, 35 to directly feed the monopole 32 and to feed the ILA 34 through the connection 37 between the monopole 32 and the vertical leg 35 of the ILA 34.

In particular, the connection 37 is disposed between the monopole 32 and the leg 35 of the fed ILA 34 such that the connection 37 connects near the base or input end of the monopole 32, runs above and parallel to the ground plane 11, and connects to the end closest to the ground plane 11 of the vertical leg 35 of the fed ILA 34. Thus, the fed ILA 34 does not connect to the ground plane 11 in antenna 30. As illustrated in FIG. 3, the distance between the ground plane 11 and the connection 37 is h1, which may also be referred to as the height of the connection 37. The length of the vertical leg 35 of ILA 34 is H2. The length of the vertical leg 40 of the coupled ILA 36 is h1+H2.

The introduction of the monopole 32 as part of the antenna 30 causes additional differences with respect to the antenna 10 of FIG. 1. For example, the fed ILA 34 of antenna 30 includes a horizontal leg 38 of length L3. The coupled ILA 36 of antenna 30 includes a horizontal leg 42 of length L4. The respective lengths of L3 and L4 may need adjustment (as compared to their analogous parts in antenna 10) due to the connection 37. The monopole 32 is designed for resonance at a higher frequency than the ILAs. The height (h1) of the connection 37 is optimized for an optimal VSWR. Note that the connection 37 (which may be a wire) has a negligible contribution to the radiation fields due to its proximity (h<<H2) to the ground plane 11 (the radiation fields from the connection 37 will be cancelled by its image below the ground plane). This is the reason why only a slight adjustment may be needed for the position of the gap 12.

FIG. 4 is a graph 44 of frequency (GHz) vs. simulated Voltage Standing Wave Ratio (VSWR) for the exemplary antenna 30 of FIG. 3. The graph 44 illustrates the calculated VSWR for a dual-band operation in 1 GHz and 2 GHz bands where L3=12 mm; L4=36 mm; H2=46 mm; h1=4 mm; the gap 12=2 mm; the monopole=41 mm (from the connection 37 to the end of the monopole opposite the ground plane); and the wire radius=1 mm.

Graph 44 illustrates there are two distinct bandwidths where the VSWR is less than 2: a lower area 46 and an upper area 48. Advantageously, the upper area 48 stretches over a wide band of frequencies. The VSWR in the upper area (or higher band) 48 is quite low and has a flat variation (VSWR≦1.5 from 1.6 to 2.5 GHz). Such a dual and broadband antenna is suitable for use in AMPS/PCS, GSM/DCS, PDC/PHS, IMT2000 and 2.4 GHz ISM band WLAN.

Figure 5:
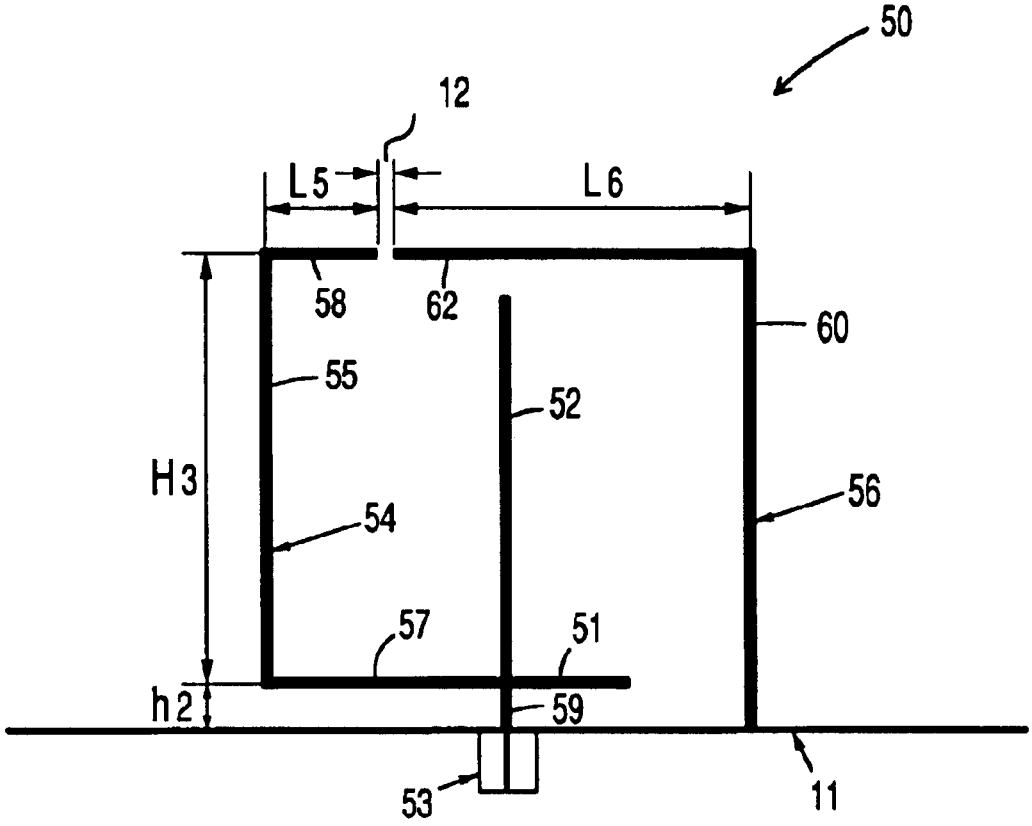
FIG. 5 illustrates an exemplary planar triple-band loop-monopole antenna according to the inventions
Figure 6:
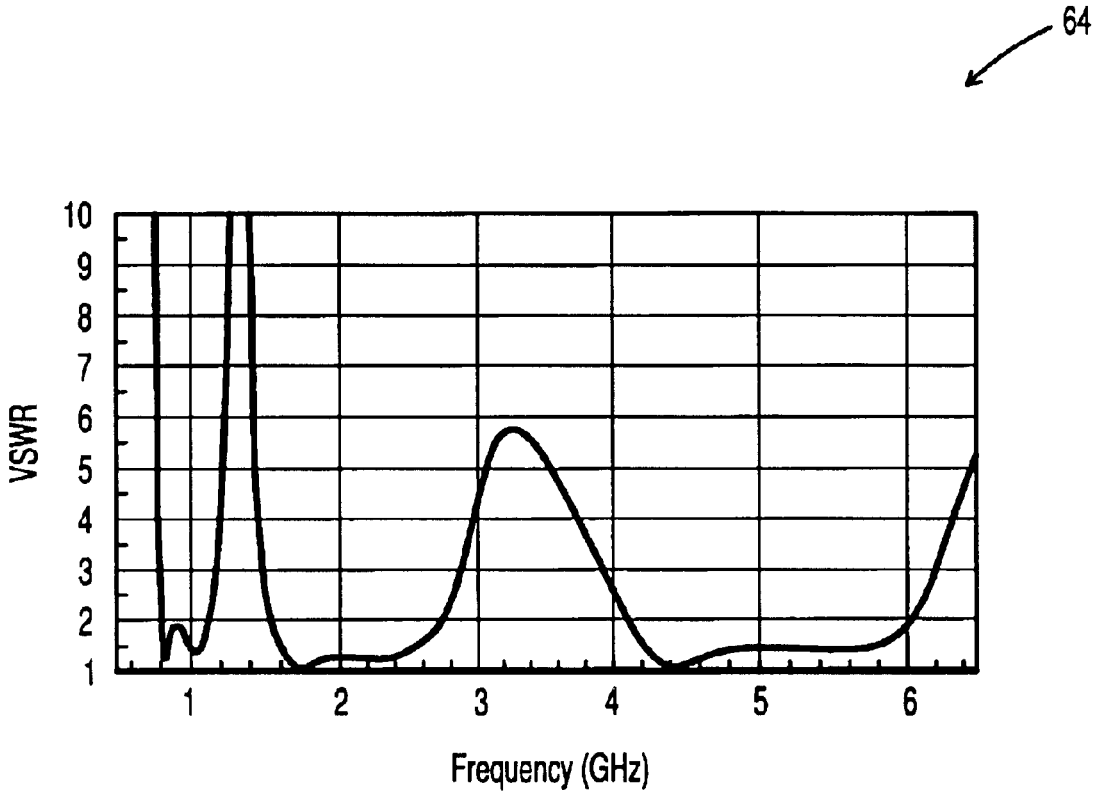
FIG. 6 is a graph of the VSWR for the exemplary antenna of FIG. 5.

FIGS. 5–6—Triple-Band Antenna

FIG. 5 illustrates an exemplary triple-band broadband planar antenna 50 according to the inventions. A triple-band antenna may be particularly advantageous so as to be used in connection with the 5 GHz ISM band for WLAN applications in mobile devices and other units.

The antenna 50 of FIG. 5 is similar to the antenna 30 of FIG. 3, but for the addition of a wire (also referred to as conductor) 51 that is connected to the monopole antenna 52 opposite to the connection 57 between the monopole antenna 52 and the vertical leg 55 of the ILA 54. The addition of the conductor 51 allows for triple band operation of the antenna 50.

Particularly, the antenna 50 of FIG. 5 may be considered to be comprised of two Inverted-L antennas (ILAs) 54, 56 that face each other across a gap 12. ILA 54 includes a vertical leg 55 and horizontal leg 58, which is of length L5. ILA 56 includes a vertical leg 60 and a horizontal leg 62, which is of length L6.

A vertical monopole antenna 52 is disposed between the ILAs 54, 56. The monopole 52 is fed through a feed probe 59 from an input 53, which also feeds ILA 54 through a connection 57 from the monopole 52 to the vertical leg 55 of the ILA 54. The connection 57 connects near the base or input end of the monopole 52, runs above and parallel to the ground plane 11, and connects to the end closes to the ground plane 11 of the vertical leg 55 of the fed ILA 54. As illustrated in FIG. 5, the distance between the ground plane 11 and the connection 57 is h2. In the exemplary embodiment, the feed probe 59 between the input 53 has the height of h2. The length of the vertical leg 55 of ILA 54 is H3. The length of the vertical leg 60 of ILA 56 is h2+H3. ILA 56 is electromagnetically coupled to ILA 54 and/or may be coupled to the other parts of the antenna 50.

As noted, a wire or conductor 51 is connected to the monopole antenna 52 opposite to the connection 57. The conductor 51 extends horizontally from the monopole 52 in the direction of, but does not reach, the vertical leg 60 of the ILA 56. The conductor 51 with the feed probe 59 acts as an ILA and allows for three band operation of antenna 50. In the example described in connection with FIGS. 5 and 6, the ILA composed of the conductor 51 and the feed probe 59 acts with respect to the 5 GHz band. Given its configuration including the 2 ILAs 54, 56 forming a loop (but for the gap 12), the monopole 52, and the ILA composed of the conductor 51 and the feed probe 59, the antenna 50 may be referred to as a triple-band loop-monopole-ILA. Note that the radiation contribution from the connection 57 and/or the conductor 51 is no longer negligible in the 5 GHz band since h2 becomes comparable to a fraction of one wavelength in this example.

FIG. 6 is a graph 64 of frequency (GHz) vs. simulated Voltage Standing Wave Ratio (VSWR) for the exemplary antenna 50 of FIG. 5. The graph 64 illustrates the calculated VSWR for a triple-band operation where L5=12 mm; L6=36 mm; H3=46 mm; the gap=2 mm; the monopole 52=10 mm; the conductor 51=10 mm; and the wire radius=1 mm.

Advantageously, a third, additional broadband (38%) is obtained in the 5 GHz band (or band 3) over the previous exemplary antenna 30 described in connection with FIGS. 3–4. This broadband performance also benefits from a combination of the fundamental mode of the additional ILA (the conductor 51 and the feed probe 59) and the high-order modes of the two ILAs 54, 56 and the monopole 52. The addition of the ILA (the conductor 51 and the feed probe 59) does not affect the broadband performance of the original dual-band antenna (antenna 30) in the lower 1 GHz and 2 GHz bands.

Figure 7:
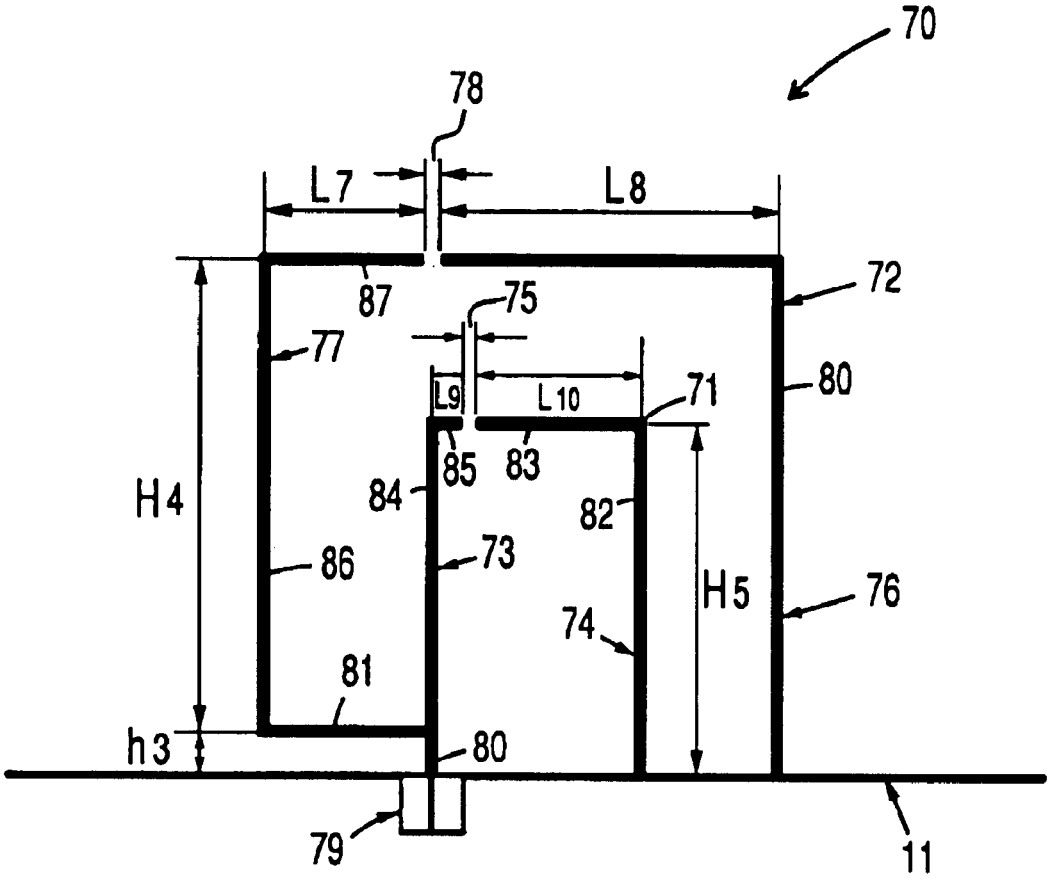
FIG. 7 illustrates an exemplary planar dual-band loop-loop antenna according to the inventions.
Figure 8:
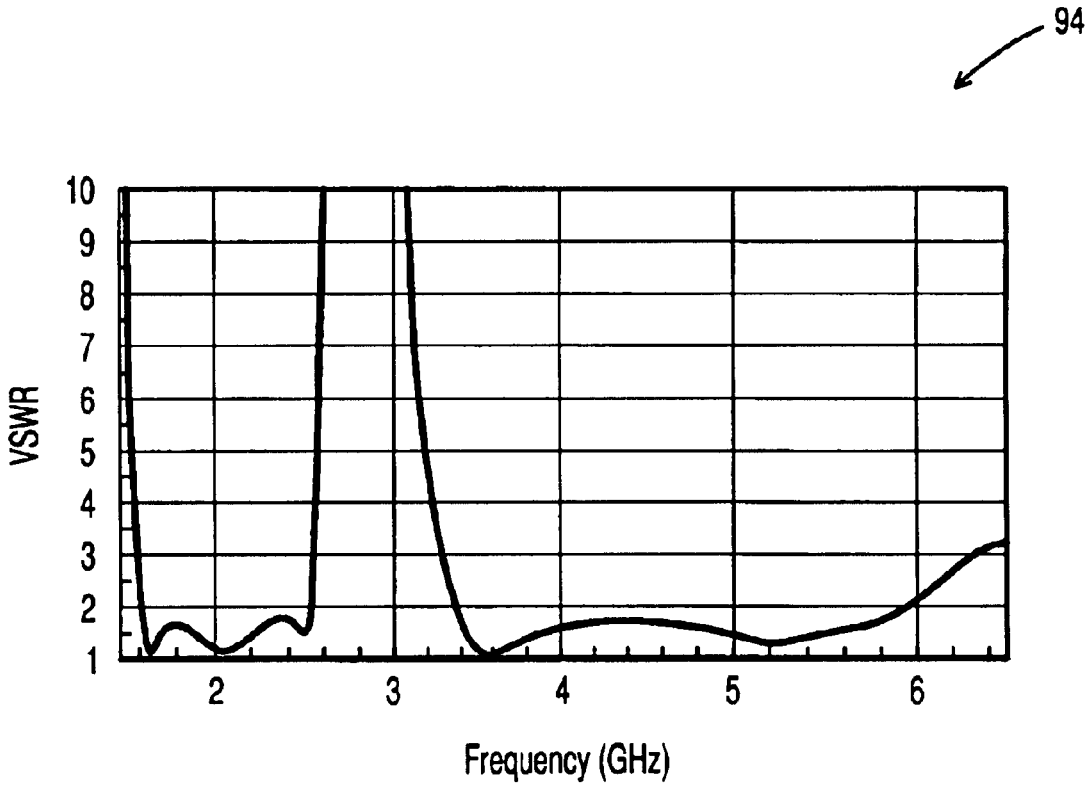
FIG. 8 is a graph of the VSWR for the exemplary antenna of FIG. 7.

FIGS. 7–8—Dual-Band Loop-Loop Antenna

FIG. 7 illustrates another exemplary dual-band broadband planar antenna 70 according to the inventions. In some applications, an antenna may only need to cover the 2 GHz and 5 GHz bands. In such circumstances, the physical size of the antenna may be reduced, but there is a need to increase the bandwidth of the lower band in order to cover all the mobile communication and WLAN applications in the 2 GHz band. This need can be satisfied through an introduction of two cut loops, which results in a dual-band loop-loop antenna. An example of such an antenna is shown in FIG. 7.

The exemplary antenna 70 of FIG. 7 includes an inner cut loop 71 and an outer cut loop 72. As the terms imply, the inner cut loop 71 is set within the outer cut loop 72. The inner cut loop 71 includes two ILAs 73, 74, which are positioned with respect to each other (like in the previously described antenna examples) so that the ILAs face each other across a gap 75. The outer cut loop 72 also includes two ILAs 76, 77, which are also positioned so that the ILAs face each other across a gap 78.

Both the inner cut loop 71 and the outer cut loop 72 include an ILA that is fed input 79 with the other ILA in the loop being electromagnetically coupled. With respect to the inner cut loop 71, the ILA 73 is directly fed while the ILA 74 is electromagnetically coupled. With respect to the outer cut loop 72, the ILA 77 is fed from input 79 via feed probe 80 and connection 81. The configuration of the feeding of ILA 77 is similar to the feeding of ILA 54 as described in connection with antenna 50 shown in FIG. 5.

Further, the coupled ILA 74 of the inner cut loop 71 has a vertical leg 82 of height H5 and a horizontal leg 83 of L10. The fed ILA 73 of the inner cut loop 71 has a vertical leg 84 whose height, when combined with the height of the feed probe 80, equals the height of the vertical leg 82 of the coupled ILA 74. The fed ILA 73 also has a horizontal leg 85 of length L9.

The fed ILA 77 of the outer cut loop 72 has a vertical leg 86 of a height H4. The fed ILA 77 also has a horizontal leg 87 of length L7, which is also the length of the connector 81. The coupled ILA 76 of the outer cut loop 72 has a vertical leg of a height H4+h3 where h3 is the height of the connector 81 between the fed ILA 73 of the inner cut loop 71 and the fed ILA 77 of the outer cut loop 72. The coupled ILA 76 has a horizontal leg of length L8.

The simulated VSWR of the exemplary dual-band loop-loop antenna 70 is plotted in the graph 94 shown in FIG. 8. The bandwidth of the lower band is increased to 44% from 31% and the bandwidth of the higher band keeps 55%. The increase in the bandwidth in the lower band (band 1) is attributed to the combination of three resonant frequencies, which respectively correspond to three ILAs: the fed ILA 77 of the outer cut loop 72; the coupled ILA 76 of the outer cut loop 72; and the coupled ILA 74 of the inner cut loop 71. The fed ILA 73 of the inner cut loop 71 has a similar function in the antenna 70 shown in FIG. 7 as the monopole antenna 52 in FIG. 5, which leads to a broadband performance in the higher band (band 2).

Conclusion

Advantageously, the features and functions of the inventions described herein allow for their use in many different manufacturing configurations. For applications in a wireless communication handheld terminal (e.g., a mobile phone handset), an antenna per the inventions can be printed on a printed circuit board (PCB) or an electrically thin dielectric substrate (e.g. RT/duroid 5880). The printed piece can be mounted either (a) at the top of the handset backside or (b) at the bottom of the front side of the handset. The top-mounted configuration can serve as a "flip" cover of the handset while the bottom-mounted mouthpiece can be integrated with a microphone.

From the foregoing description of the exemplary embodiments of the inventions and operation thereof, other embodiments will suggest themselves to those skilled in the art. Therefore, the scope of the inventions is to be limited only by the claims below and equivalents thereof.

We claim:

1. An antenna, comprising:

an inverted-L antenna (ILA) fed by an input; and an ILA electromagnetically coupled with respect to the fed ILA, facing the fed ILA, and separated from the fed ILA by a gap, whereby positioning of the gap determines bandwidth of the antenna, and wherein the fed ILA, the coupled ILA, and the gap are positioned with respect to each other to form three sides of a square, wherein the coupled ILA comprises a horizontal leg; and wherein the horizontal leg of the fed ILA is shorter than the horizontal leg of the coupled ILA.

2. A dual-band antenna, comprising:

a first inverted-L antenna (ILA);

a second ILA electromagnetically coupled with respect to the first ILA, facing the first ILA, and separated from the first ILA by a gap;

a monopole antenna disposed between the first ILA and the second ILA, and operative to receive input; and a connection between the monopole antenna and the first ILA to feed input to the first ILA.

3. The dual-band antenna of claim 2, wherein the second ILA is longer than the first ILA.

4. The dual-band antenna of claim 2, wherein the first ILA comprises a horizontal leg;

wherein the second ILA comprises a horizontal leg; and wherein the horizontal Leg of the first ILA is shorter than the horizontal leg of the second ILA.

5. The dual-band antenna of claim 2, wherein the first ILA comprises a vertical leg;

wherein the second ILA comprises a vertical leg; and wherein the monopole antenna is centered between the vertical leg of the first ILA and the vertical leg of the second ILA.

6. The dual-band antenna of claim 5, wherein the monopole antenna is shorter in length than the vertical leg of the second ILA.

7. The dual-band antenna of claim 2, wherein the connection connects to the monopole antenna near its base and connects to the first ILA at its base.

8. A triple-band antenna, comprising:

a first inverted-L antenna (ILA);

a second ILA electromagnetically coupled with respect to the first ILA, facing the first ILA, and separated from the first ILA by a gap;

a monopole antenna disposed between the first ILA and the second ILA, and operative to receive input from a feed probe longitudinally lined up with the monopole antenna;

a connection between the monopole antenna and the first ILA to feed the input to the first ILA; and a conductor connected to the monopole antenna opposite to the connection, and the conductor extends horizontally from the monopole antenna towards, but not reaching, the second ILA, whereby the conductor and the feed probe form a third ILA.

9. The triple-band antenna of claim 8, wherein the second ILA is longer than the first ILA.

10. The triple-band antenna of claim 8, wherein the first ILA comprises a horizontal leg;

wherein the second ILA comprises a horizontal leg; and wherein the horizontal leg of the first ILA is shorter than the horizontal leg of the second ILA.

11. The triple-band antenna of claim 8, wherein the first ILA comprises a vertical leg;

wherein the second ILA comprises a vertical leg; and wherein the monopole antenna is centered between the vertical leg of the first ILA and the vertical leg of the second ILA.

12. The triple-band antenna of claim 11, wherein the monopole antenna is shorter in length than the vertical leg of the second ILA.

13. The triple-band antenna of claim 8, wherein the connection connects to the monopole antenna near its base and connects to the first ILA at its base.

14. A dual-band antenna, comprising:

an inner cut loop antenna with a first inverted-L antenna (ILA) facing a second ILA across a first gap, and with the first ILA being fed input while the second ILA is electromagnetically coupled at least to the first ILA;

an outer cut loop antenna encompassing the inner cut loop antenna; and the outer cut loop antenna including a third ILA facing a fourth ILA across a second gap, with the third ILA being fed input via a feed probe and a connection connected to the first ILA of the inner cut loop antenna while the fourth ILA is electromagnetically coupled at least to the third ILA.

15. The dual-band antenna of claim 14, wherein the third ILA of the outer cut loop comprises a horizontal leg having a length L; and wherein the connection has the length L.

16. The dual-band antenna of claim 14, wherein the second ILA is longer than the first ILA.

17. The dual-band antenna of claim 14, wherein the fourth ILA is longer than the third ILA.

18. The dual-band antenna of claim 14, wherein the first ILA comprises a horizontal leg;

wherein the second ILA comprises a horizontal leg; and wherein the horizontal leg of the first ILA is shorter than the horizontal leg of the second ILA.

19. The dual-band antenna of claim 14, wherein the third ILA comprises a horizontal leg;

wherein the fourth ILA comprises a horizontal leg; and wherein the horizontal leg of the third ILA is shorter than the horizontal leg of the fourth ILA.

20. The dual-band antenna of claim 14, wherein the connection connects to the first ILA near its base and connects to the third ILA at its base.

* * * * *